United States Patent [19]

Olson

[11] 4,334,375

[45] Jun. 15, 1982

[54] APPARATUS FOR COLLECTING CARTRIDGE CASINGS

[75] Inventor: Marvin C. Olson, San Jose, Calif.

[73] Assignee: FMC Corporation, Chicago, Ill.

[21] Appl. No.: 116,331

[22] Filed: Jan. 28, 1980

[51] Int. Cl.[3] ..... F41C 27/00

[52] U.S. Cl. ..... 42/1 T

[58] Field of Search ..... 42/1 T; 89/33 F

[56] References Cited

U.S. PATENT DOCUMENTS

| | | | |
|---|---|---|---|
| 1,201,189 | 10/1916 | Johnson | 42/1 T |
| 2,354,277 | 7/1944 | Richardson | 42/1 T |
| 3,739,685 | 6/1973 | Lungren | 42/1 T |
| 4,028,834 | 6/1977 | Dobson | 42/1 T |
| 4,110,927 | 9/1978 | Morris | 42/1 T |

*Primary Examiner*—Charles T. Jordan

*Attorney, Agent, or Firm*—H. M. Stanley; R. B. Megley

[57] ABSTRACT

A container is arranged to be quickly attached to or removed from a closed chute that is disposed around the ejection port of a submachine gun so that empty cartridge casings expelled from the gun are deposited into the container in a manner such that gases remaining in the casings cannot escape into the surrounding atmosphere. The container is capable of being sealed after the casings are received thereon.

7 Claims, 4 Drawing Figures

FIG_2
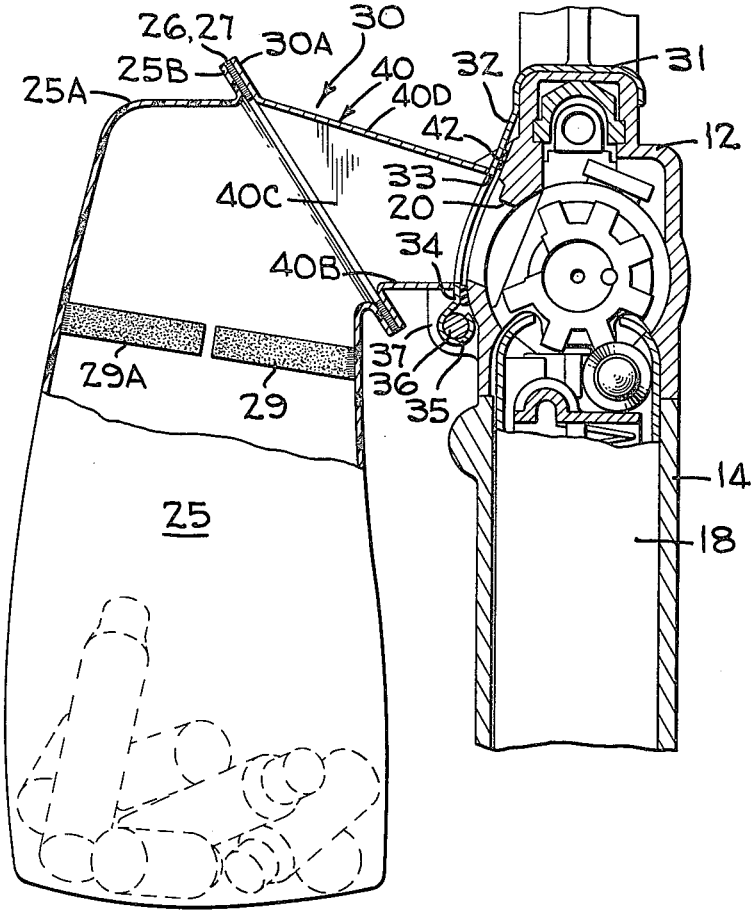
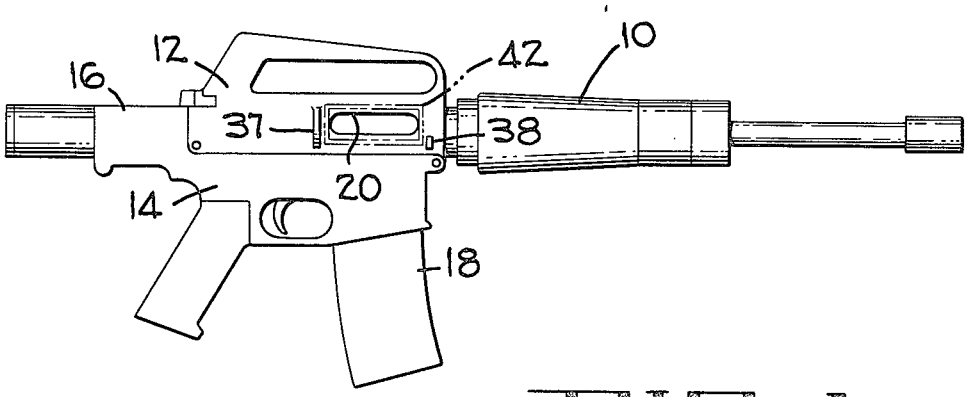
FIG_1

APPARATUS FOR COLLECTING CARTRIDGE CASINGS

BACKGROUND OF THE INVENTION

1. Field of the Invention

This invention pertains to cartridge casing collection apparatus and more particularly concerns a container, such as a bag, that may be quickly and easily attached to the side of a gun in position to receive cartridge casings as they are expelled from the gun.

2. Description of the Prior Art

When a gun is fired, the explosion takes place in the cartridge casing behind the bullet and, accordingly, when the casing is immediately ejected from the gun, a quantity of gas remains in the casing. This gas is toxic and, if it accumulates in a closed compartment such as the inside of a tank or of a similar military vehicle, it may asphyxiate the occupants of the compartment.

In the past when a few guns were mounted in a tank or the like for firing through portholes in the tank by persons inside the tank, one method of handling the empty cartridge casings discharged from the gun was to mount a bag adjacent the ejection port of the gun in position to receive the casings as they were hurled out of the gun. While the bag was positioned close to the port, it was not sealed over the port and there was no attempt made to prevent gases, that might ooze from the casings as they are ejected, from escaping into the atmosphere. When the bag was almost full, it was removed from the gun and dropped on the floor of the vehicle. An exhaust system in the vehicle was relied on to continuously remove gases from the interior of the vehicle at a rate fast enough to insure that no toxic accumulation of gases would result. It has been determined that, when approximately seven M16 submachine guns are mounted in a closed vehicle for rapid firing through portholes, a central exhaust system of practicable size probably would not be capable of removing gases fast enough if the casings are collected in bags and the unsealed bags are dropped on the floor of the vehicle.

Accordingly, it is an object of the present invention to provide apparatus for collecting cartridge casings ejected from a gun in a manner such that substantially no gases escape to the interior of the vehicle in which the guns are mounted.

Another object is to provide a casing collection container that may be removably attached to a gun to receive casings and may be sealed after casings are deposited therein so that gases will not escape to the interior of the vehicle even if the container is dropped on the floor of the vehicle.

SUMMARY OF THE INVENTION

A container such as a gas-impervious coated nylon bag is arranged to be removably sealed to a closed chute which in turn is mounted in sealed gas-tight relation over the ejection port of a gun. The container has internally disposed sealing strips which may be pressed together at the entrance end of the bag to seal the bag after it has received a desired quantity of empty cartridge casings. The chute is removably mounted on the gun by means of a saddle that fits over a projection on the gun and is locked thereon by a locking pin that engages aligned apertures in tabs on the side of the gun.

BRIEF DESCRIPTION OF THE DRAWINGS

FIG.1 is a diagrammatic side elevation of a gun of the type with which the casing collection apparatus of the present invention is adapted to be used.

FIG. 2 is a diagrammatic transverse vertical section taken through a gun and the collection apparatus of the present invention, the section particularly showing the ejection port of the gun and the chute sealed over the port.

DESCRIPTION OF THE PREFERRED EMBODIMENT

Figures 3, 4:
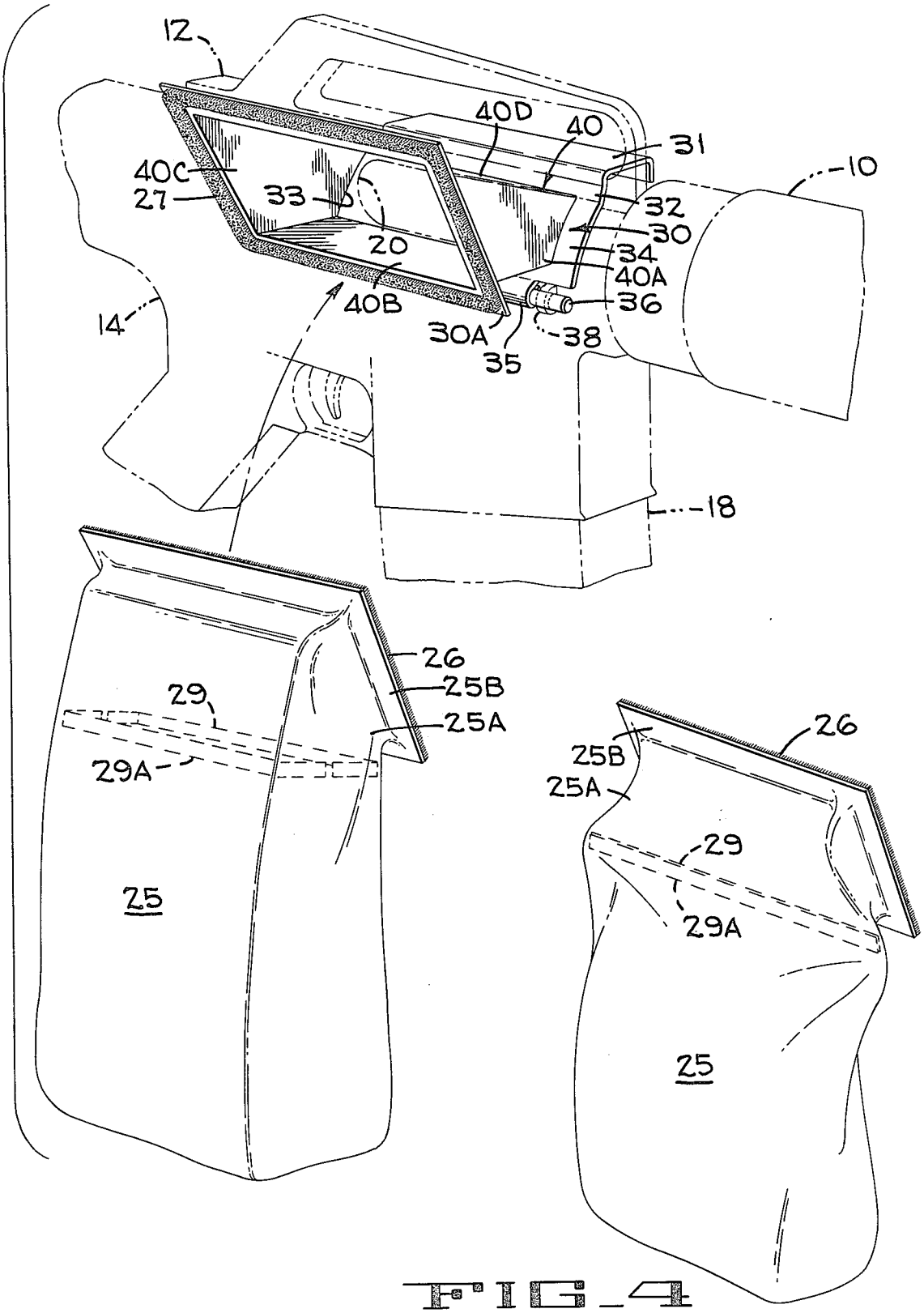
FIG. 3 is a diagrammatic, exploded perspective showing the container of the present invention in position to be attached to the chute which is mounted on a gun that is shown in phantom lines.
FIG. 4 is a diagrammatic perspective of the container of the present invention after its upper end has been closed and sealed.

In FIG. 1 is illustrated diagrammatically a gun of the type with which the cartridge casing collector system of the present invention is adapted to be used. The gun is a submachine gun and comprises, in general, a barrel assembly 10, an upper receiver 12 secured to the rear end of the barrel assembly, a lower receiver 14 which is attached to the lower side of the upper receiver 12, a receiver-extension 16 which is connected to the rearward end of the lower receiver, and an ammunition magazine 18. This gun is identified as an M16 submachine gun by the U.S. Army and, in accordance with well-known principles, a bolt and bolt carrier are slidably mounted in the upper receiver 12. When the bolt and bolt carrier are disposed near the left end of the upper receiver, a loaded cartridge is fed upwardly from the magazine 18 to a position in front of the bolt. When the bolt is moved forwardly (to the right, FIG. 1), the cartridge is moved forwardly into the firing chamber near the rear of the barrel assembly 10. After the gun has been fired and the bullet has left the cartridge casing, the casing is retracted rearwardly by the bolt and is ejected laterally through an aperture or port 20 in the upper receiver. The cartridge casing collection system of the present invention is adapted to receive spent casings that are ejected through the port 20.

The collection system comprises a container 25 (FIG. 2) which may be a nylon bag or pouch which is coated with a material, such as a vinyl, which makes the container impervious to the passage of gases. The upper end portions 25A of the container has a flange 25B of generally rectangular configuration (FIG. 3). A strip of tape 26, which is secured by a suitable adhesive or is sewn to the flange 25B, is made of a material marketed by the Textron, Inc. Company of New York, N. Y. under the trademark Velcro. A velcro tape consists of two mating strips which tightly grip each other when they are brought into engagement. In the present arrangement, the mating strip of the strip 26 on flange 25B is a strip 27 which is arranged in rectangular configuration and secured by a suitable adhesive to a rectangular flange 30A of a metal ejection chute 30. It will be evident that, when the velcro strip 26 is pressed against the velcro strip 27, the bag is removably secured to the ejection chute. It is a feature of velcro material that the two mating strips immediately grip each other and can be separated only by a positive separating or tearing-away action.

Near the upper end portion 25A of the container, mating velcro strips 29 and 29A are secured to opposed inner wall portions of the container. When the container is to be closed as shown in FIG. 4, the opposed strips are merely pressed together.

The ejection chute 30 is connected to the gun by means of a mounting member in the form of a saddle 31 which, as seen in FIG. 2, fits snugly over an upwardly projecting portion of the upper receiver 12. An inclined plate 32, which extends downwardly from one side of the saddle, is provided with an opening 33 which is in communication with the ejection port 20 of the gun, the opening 33 being somewhat larger than the port as seen in FIGS. 2 and 3.

The inclined plate 32 has a lower curved section 34 and, at the lower end of the curved portion 34, a tubular locking member 35 is integrally formed on the plate to receive a locking pin 36 which is removably disposed in aligned apertures in tabs 37 and 38 (FIG. 1) formed on the outer surface of the gun. In FIG. 3 the ejection chute 30 is shown locked on the gun.

The chute 30 includes a generally tubular body 40 which includes walls 40A–40D and is formed integrally with flange 30A and is secured, as by welding, in the opening 33 of the curved section 34. The body 40 thus provides a closed passage between the ejection port 20 of the gun and the container 25.

Referring to FIG. 2 it will be particularly noted that a gasket 42 is disposed between the side surface of the gun around the ejection port 20 and the flange formed on the entrance end of the chute by the inclined plate 32 and its curved section 34. The gasket 42 is of generally rectangular configuration as indicated in dotted lines in FIG. 1 and is of rubber or a similar compressible material so that when the ejection chute 30 is locked on the gun, the gasket firmly engages the wall of the chute and the wall of the gun, and provides a gas-tight joint between these two members.

It will be evident that, while the ejection chute may be quickly and easily removed from the gun by removal of pin 36, during operation of the gun the chute is locked in place. As the spent casings are ejected from the gun, they pass through the chute and are collected in the container 25. When the container is filled to a point somewhat below the tapes 29–29A, the container is stripped from the end of the ejection chute and an empty container is positioned thereon. The tapes 29–29A of the container that has been removed are pressed together to seal the container and prevent the escape of the gases that remain in the casings.

While the preferred embodiment disclosed herein makes use of velcro to removably secure the container to the flange 30A of the chute, it is within the teaching of the present invention to provide other types of attaching or clamping apparatus for removably mounting the container. Velcro provides a quick, easy connection.

The velcro 29 and 29A which are adapted to seat the container may be replaced with other sealing apparatus such as the flat spring type closures typically used on some tobacco pouches.

From the foregoing discussion it will be apparent that the present invention provides a system for collecting empty casings from spent cartridges in a manner that prevents the escape of gases to the area in the vicinity of the gun.

Although the best mode contemplated for carrying out the present invention has been herein shown and described, it will be apparent that modification and variation may be made without departing from what is regarded to be the subject matter of the invention.

What I claim as new and desire to protect by Letters Patent is:

1. Apparatus for collecting empty casings discharged through an ejection port in a wall of a gun comprising a container, means for attaching the entrance end of said container to the section of the wall of the gun surrounding the ejection port, and means for establishing a gas-tight seal between the wall of said gun around the ejection port and the entrance end of said container.

2. Apparatus according to claim 1 wherein said attaching means includes means for quickly attaching and removing said container.

3. Apparatus for collecting empty casings discharged through an ejection port in a wall of a gun comprising a container, and means for attaching the entrance end of said container to the section of the wall of the gun surrounding the ejection port, said attaching means including a rigid chute, a sealing gasket between said chute and the area of the gun surrounding the ejection port, and means for detachably securing the entrance end of said container to said chute.

4. Apparatus for collecting empty casings discharged through an ejection port in a wall of a gun comprising a container; and means for attaching the entrance end of said container to the section of the wall of the gun surrounding the ejection port; said attaching means including a rigid chute connected between the gun and the entrance end of the container and a rigid saddle disposed over a mating portion of the gun, a plate extending away from said saddle and alongside the area of the gun surrounding the ejection port, means defining an aperture in said plate in communication with the port, a tubular locking member on said plate on the opposite side of said aperture from said saddle, and means engageable with said locking member for securing said attaching means to the gun.

5. Apparatus for collecting empty casings discharged through an ejection port in a wall of a gun comprising a container, means for attaching the entrance end of said container to the section of the wall of the gun surrounding the ejection port, and means for sealing the entrance end of the container against outward passage of gases.

6. Apparatus for collecting empty casings discharged through an ejection port in a wall of a gun comprising a container, and means for attaching the entrance end of said container to the section of the wall of the gun surrounding the ejection port, said attaching means including a rigid flange secured to the gun, and velcro tapes disposed respectively on said container and on said flange.

7. Apparatus for collecting empty casings discharged through an ejection port in a wall of a gun comprising a container, and means for attaching the entrance end of said container to the section of the wall of the gun surrounding the ejection port, said attaching means including a rigid saddle disposed over a mating portion of the gun, a plate extending away from said saddle and alongside the area of the gun surrounding the ejection port, mean defining an aperture in said plate in communication with the port, a tubular locking member on said plate on the opposite side of said aperture from said saddle, and means engageable with said locking member for securing said attaching means to the gun.

* * * * *